United States Patent [19]

Soucy

[11] 4,363,192

[45] Dec. 14, 1982

[54] WINDOW MOUNTING SYSTEM

[76] Inventor: Armand L. Soucy, 337 Maple St., Lynn, Mass. 01904

[21] Appl. No.: 249,008

[22] Filed: Mar. 30, 1981

[51] Int. Cl.[3] ..... E05D 15/16

[52] U.S. Cl. ..... 49/453; 49/63; 49/459

[58] Field of Search ..... 49/453, 454, 459, 63, 49/463, 428

[56] References Cited

U.S. PATENT DOCUMENTS

| | | | |
|---|---|---|---|
| 3,293,802 | 12/1966 | Fletcher | 49/453 X |
| 3,325,944 | 6/1967 | Crain | 49/453 X |
| 3,377,747 | 4/1968 | Donkin | 49/453 X |
| 3,611,636 | 10/1971 | Trout | 49/453 X |
| 4,226,050 | 10/1980 | Kessler | 49/453 X |

*Primary Examiner*—Philip C. Kannan
*Attorney, Agent, or Firm*—Joseph S. Iandiorio

[57] ABSTRACT

A window mounting system including: a track member having a base for attachment to a window frame; a side wall extending transversely to the base; and a cover extending from the side wall parallel to the base having a curved shape facing the base, the distal end of the cover being spaced from the base to form an opening; and a slide member including a runner having a curved shape for nesting in the track member and slidingly engaging therewith, the width of the runner being greater than the width of the opening between the cover and base of the track member to allow for snap-insertion; a runner extension; and glazing support means fixed to the runner extension.

54 Claims, 10 Drawing Figures

WINDOW MOUNTING SYSTEM

FIELD OF INVENTION

This invention relates to a window mounting system.

BACKGROUND OF INVENTION

A window is mounted to a window frame by one of a number of mounting systems. Many such systems permanently mount the window to the frame. Such systems are inappropriate for use with storm, solar, or other auxiliary windows which may require frequent (such as seasonal) changing or repair. For such uses a mounting system is required that allows quick and easy insertion and removal of the window, while at the same time providing a tight seal preventing access of the elements and heat loss. To serve this purpose, present auxiliary window mounting systems typically include channels mounted to a frame and into which the window is slid. Many such assemblies further employ hooks, clips, screws, nails, and other fastening devices. The present invention addresses a number of deficiencies exhibited by the prior art window mounting systems.

Of prime concern is the poor window fit provided by many present systems. A loose fit results in heat loss, drafts, and noisy window rattling. If, on the other hand, the window is too tightly installed in the frame, difficulty arises when attempting to remove the window for changing or cleaning.

Present window mounting systems often involve an undue amount of time and effort to install. A screwdriver or other tools may be required. Once attached to the frame, many systems are not intended to be removed and thus remain mounted all year round, even when no auxiliary window is in use. Such idle assemblies are likely to be unattractive and hinder other uses of the window frame.

When the aforementioned sliding channels are utilized, it is often possible to install the window only by sliding it in from the top. Such installation may require a stepladder and annoying and/or dangerous maneuvering of the window.

Several disadvantages are evident from using the previously mentioned fastening materials. Clips, nails, screws, etc. tend to be unsightly and permanently mark the frame, the surrounding wall, or the window itself. Such fasteners may rust. They may interfere with window shades or blinds. They may be awkward and require tools to install. Finally, prior art fasteners may be easily broken or lost, in which case the auxiliary window is rendered unusable.

Aside from addressing these problems, the present invention is further designed to allow mounting of storm, solar, and other auxiliary windows in such a manner as to allow opening to provide access to fresh air and convective solar heating.

SUMMARY OF INVENTION

It is therefore an object of this invention to provide an improved window mounting system which is structured to permit a window to be easily, safely, and securely installed into a window frame by snap-insertion.

It is a further object of this invention to provide a window mounting system which is structured to provide an improved window fit, thereby reducing escape of interior heated and cooled air and infiltration of exterior weather elements.

It is a further object of this invention to provide a window mounting system which is lightweight and easily attachable to a window frame without using tools and which does not require securing means such as hooks, clips, or screws which may permanently mark the window frame or its environs.

It is a further object of this invention to provide a window mounting system which presents a pleasing aesthetic appearance without hindering the installation of blinds, shades, or other window apparatus.

It is a further object of this invention to provide a window mounting system which slidably accommodates one or more windows, thereby permitting easy opening to obtain access to fresh air and to heat the interior through convection.

It is a further object of this invention to provide an auxiliary window system which incorporates all of the aforementioned objects and further provides an improved barrier preventing escape of interior heated or cooled air and infiltration of outside weather elements, and which acts as a passive solar collector or an active solar convective heater.

This invention features a window mounting system having a track member and a slide member. The track member has a base for attachment to a window frame, a side wall extending transversely to the base, and a cover extending from the side wall parallel to the base and having a curved shape facing the base, the distal end of the cover being spaced from the base to form an opening. The slide member includes a runner having a curved shape for nesting in the track member and slidingly engaging therewith, the width of the runner is greater than the width of the opening between the cover and base of the track member to allow for snap-insertion, and further includes a runner extension and glazing support means fixed to the runner extension.

In a preferred embodiment, the base includes a recess for holding adhesive means for securing the track member to a window frame. The cover may have a generally concave shape facing the base and the runner may have a concave shape for nesting therein. The cover includes a planar portion parallel to the base and an angled portion at each end which extends outwardly from the planar portion and toward the base; one of the angled portions interconnects with the side wall. A sliding seal may be included between the runner and the track member and may be fixed to one of them. In particular, the seal may be between the concave runner portion and the base. The runner may include a planar portion and an angle portion at each end which extends outwardly from the planar portion; one of the angle portions is interconnected with the runner extension.

Alternatively, the runner may include a chamber having an opening which is narrower than the interior thereof. The opening faces the base when the runner is snap-inserted into the track. In such an embodiment there may be included a sliding seal having a thick portion received by the chamber and having a width greater than the chamber opening and a thin portion extending between the thick portion and the base member. The seal may be fixed to either the runner or the base. The slide member may further include a bearing member fixed to the runner extension for bearing on the window frame.

This invention also features a window mounting system having first and second track members and complementary first and second slide members. The first track member has a base for attachment to a window frame, a side wall extending transversely to the base, and a cover extending from the side wall parallel to the base and having a curved shape facing the base; the distal end of the cover is spaced from the base to form an opening. The first slide member includes a runner having a curved shape for nesting in the first track member and slidingly engaging therewith; the width of the runner is greater than the width of the opening between the cover and base of the first track member to allow for snap-insertion, and further includes a runner extension, and glazing support means fixed to the runner extension.

The second track member has a base connected with the first track member, a side wall extending transversely to the base, and a cover extending from the side wall parallel to the base having a curved shape facing the base; the distal end of the cover is spaced from the base to form an opening. The second slide member includes a runner having a curved shape for nesting in the second track member and slidingly engaging therewith; the width of the runner is greater than the width of the opening between the cover and base of the second track member to allow for snap-insertion, and further includes a runner extension, and glazing support means fixed to the runner extension.

The base of the first track member may include a recess for holding adhesive means for securing the track member to a window frame. In each track unit the cover may have a concave shape facing the base and the associated runner may have a concave shape for nesting within the track. Each cover may include a planar portion parallel to the base and an angle portion at each end which extends outwardly from the planar portion and toward the base; one of the angle portions interconnects with the side wall. A sliding seal may be included between the runner of each slide member and the complementary track member and may be fixed to one of them. In particular, the sliding seal may be between the concave runner portion of each slide member and the base of the complementary track member. The runner may include a planar portion and an angle portion at each end which extends outwardly from the planar portion, one of the angle portions is interconnected with the extension. Alternatively, each slide member may include a chamber having an opening which is narrower than the interior thereof. The opening faces the base when the runner is snap-inserted into the associated track. In such an embodiment, there may be for each track unit/slide member combination a sliding seal having a thick portion received by the chamber and having a width greater than the channel opening, and further having a thin portion extending between the thick portion and the base member. Each seal may be fixed to either the runner or base with which it is associated and fixed to one of them.

The first slide member may include a bearing member carried by the first slide member runner extension for bearing on the window frame. The second slide member may include a bearing member carried by the second slide member runner extension for bearing on the first track member.

Additionally, this invention features a single auxiliary window system having a glazing member and a mounting system which incorporates each of the features and embodiments of the aforementioned single track and slide member system, and a double auxiliary window system having first and second glazing members and a complementary double track/slide member system which incorporates the features of the previously described double track/slide member system.

DISCLOSURE OF PREFERRED EMBODIMENT

Other objects, features and advantages will occur from the following description of a preferred embodiment and the accompanying drawings, in which.

Figure 1:
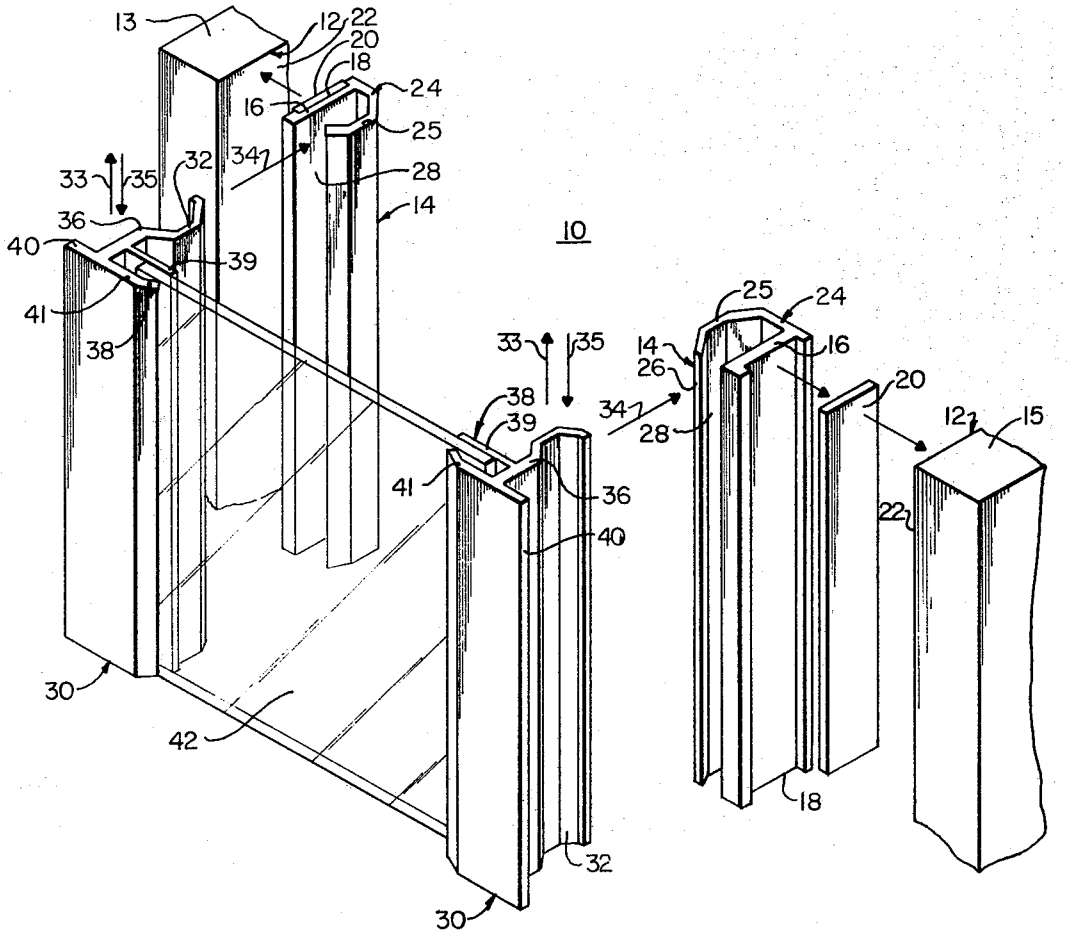
FIG. 1 is an exploded isometric view of a window mounting system and an auxiliary window system according to this invention, showing how the systems are mounted to a window frame.

A window mounting system according to this invention may be effected using a track member and a slide member, typically composed of lightweight molded material such as plastic. The track member has a base member which may have a recess or other means for holding adhesive means which secure the track to a window frame. Adhesive means may include double coated urethane foam tape or any other suitable adherent fastening means, e.g. screws, clips. The track member includes a side wall extending from the side wall parallel to the base. The cover has a curved, generally concave, shape facing the base and may include a planar portion parallel to the base and an angle portion at each end of the planar portion and extending outwardly therefrom. In such an embodiment one of the angle portions interconnects with the side wall. The distal end of the cover is spaced from the base to form an opening.

The slide member includes a curved, generally concave shaped runner for nesting in the track member and slidingly engaging therewith. Window support means for securing the glazing members are fixed to a runner extension. It is preferred that a bearing member for bearing against the window frame, and thus reducing drafts or heat loss, likewise be carried by the runner extension. The bearing member also provides function to reduce window slippage. The runner is wider than the opening between the base and cover of the track member, thereby allowing the slide member runner to be snap-inserted into the track member.

The runner may have a planar portion and angle portions at both ends of the planar portion which extend outwardly therefrom. If so provided, one of these angle portions is interconnected with the runner extension.

The glazing support means may include members which are shaped to grip or otherwise provide a friction fit for a glazing member. Snaps, hooks, or other fasteners may be alternatively provided.

A sliding seal, such as weatherstripping, may be interposed between the concave runner portion of the sliding member and the track member. Such a seal may include felt or other material providing frictional contact between the runner and the track member so that the former resists sliding within the latter. It is preferred that the sliding seal be interposed between the base portion of the track member and the concave portion of the runner, although it may acceptably be interposed between the cover portion and the runner. In addition to providing the aforementioned friction, the weatherstripping serves the purpose of preventing heat loss and access of weather elements. The seal may be fixed, such as by glue, to either the runner or the track member.

Alternatively, the runner may include a chamber having an opening narrower than the interior thereof. The opening faces the base when the runner is snap-inserted into the track. In such an embodiment the runner channel receives a sliding seal having a thick portion which generally fits the interior of the chamber and a thin portion which is interposed between the wider portion and the track member. The seal may be fixed by glue or other appropriate means to either the runner or the track member.

A mounting assembly according to this invention is also provided to accommodate two glazing members. A first track member includes a base having a recess or other means for holding adhesive means which secure the track member to the window frame. The second track member has a base connected with the first track member. In all other features each of the track members is similar to the aforementioned single track member.

The double track device further receives first and second sliding members. The structure and alternative embodiments of the aforementioned sliding members are applicable to the present device; one distinction is that the sliding member which fits into the second track member has a bearing member which bears on the first track member's cover portion rather than on the frame.

The described window mounting assemblies may be disposed in a variety of window arrangements to provide the desired sliding effect. For example, in a standard rectangular window the assembly can be mounted to the two vertical sides to provide for raising and lowering, or to the two horizontal sides to accommodate windows which slide sideways.

Single and double auxiliary window systems may be effected by including either one or two glazing members, as required, with the aforementioned assemblies. The glazing members include a wide variety of transparent or translucent materials, such as glass, acrylic, or other suitable composition. Any mode of solar, storm, or other thermal window may be included to perform the desired function.

Track and slide members are preferably of a single color matching the window or surrounding decor so as to be aesthetically pleasing.

A single window system may be utilized as a thermal barrier, solar heater, storm window, or in alternative fashions. The double window system not only allows improved insulation through the use of two full frame windows, but also permits two less than full frame windows to be positioned to perform convective solar heating.

Although typically mounted inside the primary window, it is permissible that any of the systems of this invention be mounted outside the primary window.

A window system 10 according to this invention may comprise any number of sections to accommodate various sizes and shapes of window glazing and frames. There are shown in FIG. 1 the individual systems 10 as applied to opposite sides 13 and 15 of window frame 12. The following description applies generally to each of the sections.

Track member 14 includes a base 16 having a recess 18 which holds adhesive means such as tape 20 to secure track 14 to the inner edge 22 of window 12. Side wall 24 extends from base 16 to cover 25; the latter has a generally concave shape facing base 16. Cover end 26 is spaced from base 16 to form an opening 28.

Slide member 30 includes a runner 32 having a shape for nesting within the curved cover 24 of track 12 and a width greater than opening 28. Note that the curved shapes of runner 32 and cover 24 are concave with respect to base 16.

Runner 32 may thus be snap-inserted into track member 14 by pressing slide member 30 in the direction of arrows 34. The fit is such as to permit runner 32 (and thus slide member 30) to be slidable in the direction of arrows 33 and 35. Runner extension 36 extends from runner 32 and carries glazing support means 38 and a bearing member 40. Support means 38 includes support members 39 and 41 which are shaped to form a friction fit for glazing 42. Bearing member 40 extends to engage the inside edge 22 of window frame 12, thus protecting against drafts.

Figure 2:
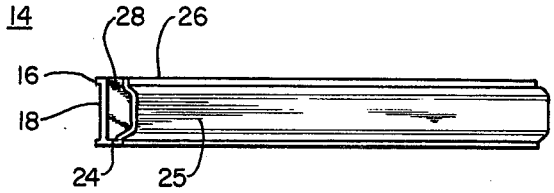
FIG. 2 is an axonometric view of a track member according to this invention.
Figure 3:
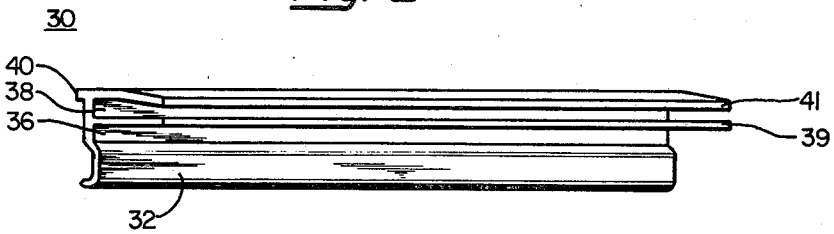
FIG. 3 is an axonometric view of a slide member according to this invention.

An alternative perspective of track member 14 alone is illustrated for clarity in FIG. 2, and a similar perspective of just the slide member is presented in FIG. 3.

Figure 4:
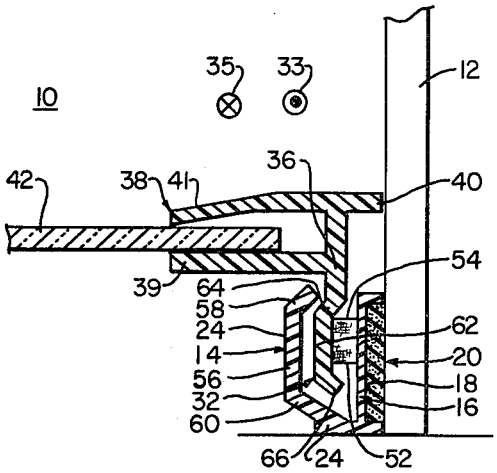
FIG. 4 is a top cross-sectional view of the window mounting system of FIG. 1.

A top view of system 10, FIG. 4, shows how runner 32 fits into track 14. Recess 18 carries tape 20, typically double-coated urethane foam tape, which secures track 14 into frame 12. Cover 24 includes a planar portion 56 and angle portions 58 and 60; portion 60 interconnects with side wall 24. Runner 32 similarly includes a planar portion 62 and angle portions 64 and 66; portion 64 interconnects with extension 36 allowing runner 32 to nest in track 14. Slide 30 is slidable in the direction of arrows 33 and 35.

Sliding seal 54, typically weatherstripping, fills the gap 52 existing between runner 32 and base 16, and may be affixed to either runner 32 or base 16. In addition to serving as weatherstripping, seal 54 provides sufficient friction bearing on runner 32 to resist sliding and maintain the position of slide member 30.

Members 39 and 41 of glazing support 38 provide a friction fit to support glazing 42. Bearing member 40 bears on frame 12.

Figure 5:
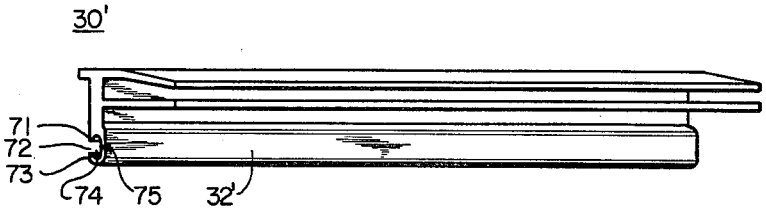
FIG. 5 is an axonometric view of an alternative slide member.

Alternative slide member 30', FIG. 5, includes lips 71 and 73 extending from the ends of runner 32' so as to form a chamber 75 having an open end 72 which is narrower than the interior 74. Slide 30' is installed into the track member 14 of this invention as in FIG. 6. Sliding seal 54' includes a thick portion 76 received in channel 75, and a narrower portion 78 extending through open end 72. Once again, the seal 54' may be glued or otherwise fixed to either runner 32 or base 16 to resist longitudinal movement thereof. Seal 54' serves both in assisting weatherproofing and in preventing unwanted sliding of the window. Other members in FIG. 6 have been removed for clarity. All such parts act analogously to those in FIG. 4.

Figure 7:
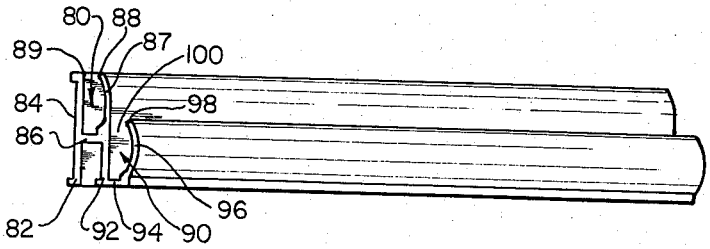
FIG. 7 is an axonometric view of a track unit having first and second track members according to this invention.

As shown in FIG. 7, this invention may include first track 80 and second track 90 having a base member 92 connected with track 80. The base 82 of track 80 has a recess 84. Track 80 has a side wall 86 extending from base 82 and a cover 87 extending from side wall 86 and having a concave shape facing base 82. Note that cover 87 is in essence a continuation of base 92. Track 90, likewise, has a side wall 94 extending from base 92 and a cover 96 extending therefrom and having a concave shape facing base 92. End 88 is spaced from base 82 to form opening 89, and end 98 is spaced from base 92 to form opening 100.

Figure 8:
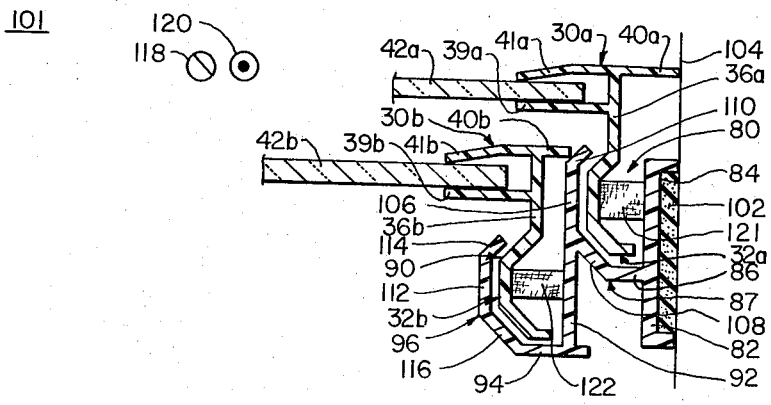
FIG. 8 is a top cross-sectional view of a window mounting system according to this invention having first and second track members accommodating first and second slide members and glazing members.

There is shown in FIG. 8 double window system 101. Recess 84 in base 82 holds tape 102 by which system 101 is mounted to frame 104. Cover 87 of track 80 includes planar portion 106 and angle portions 108 and 110; portion 108 connects with side wall 86. Cover 96 has planar portion 112 and angle portions 114 and 116; portion 116 is interconnected with side wall 94.

Slides 30*a* and 30*b* are structured and operate analogously to slide 30 of FIGS. 1, 3, and 4 (or alternatively, FIGS. 5 and 6), and accordingly the parts of slides 30*a* and 30*b*, FIG. 8, have been assigned the numbers of the previously described slide 30 accompanied by lower case "a'"s and "b'"s.

Slide 30*a* carrying glazing 42*a* is snap-inserted and slidable in the direction of arrows 118 and 120 in track 80, and slide 30*b*, carrying glazing 42*b*, is likewise received by and slidable within track 90. Note that bearing member 40*b* bears on cover 87 rather than on window frame 104.

Figure 6:
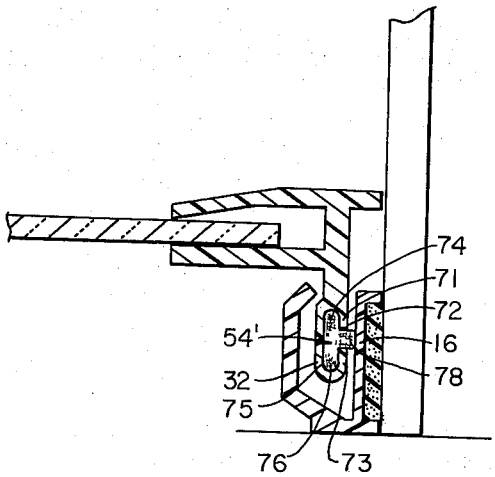
FIG. 6 is a top cross-sectional view of the slide member depicted in FIG. 5 applied to the track member of FIGS. 1, 2, and 4.

Seal 121 extends between runner 32*a* and base 82 and seal 122 extends between runner 32*b* and base 92; the aforementioned seals are structured and operate similarly to seal 54 of FIG. 4 or seal 54' of FIG. 6.

Figure 9:
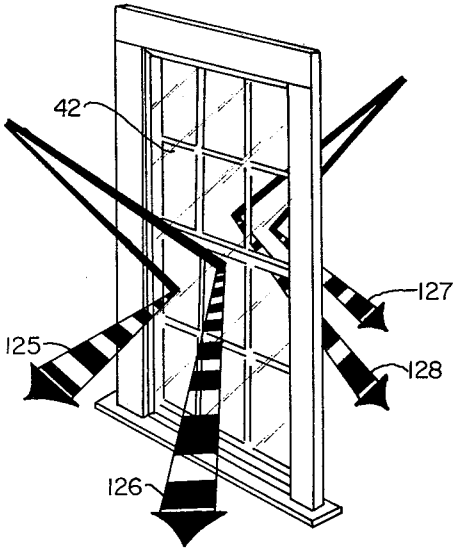
FIG. 9 is an axonometric view of a single window mounting system/auxiliary window system according to this invention used as a passive solar collector and/or thermal and weather barrier.

A storm and solar window system, FIG. 9, employing the single glazing mounting system heretofore described, may be utilized as a conventional thermal barrier. Interior heat (or air-conditioned cool air), arrows 125 and 126, is retained while exterior wind and/or cold air, arrows 127 and 128, (or alternatively hot air in air-conditioned applications) is repelled. Glazing 42 may also include a wide range of tints and glazing materials, either to enhance absorption of the sun's rays for winter use, or enhance reflection of these rays for summer use.

Figure 10:
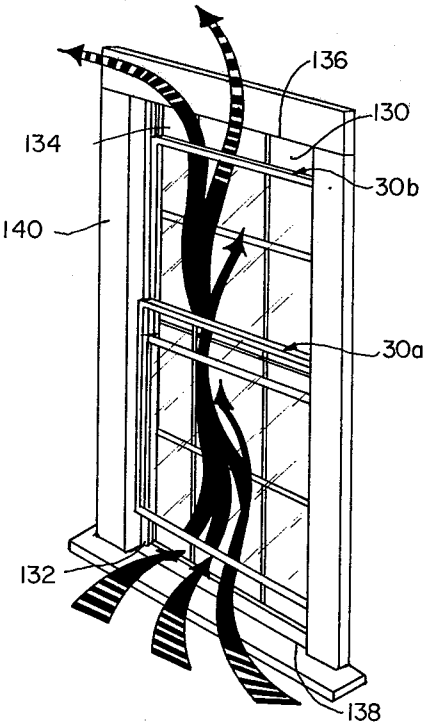
FIG. 10 is an axonometric view of a double window mounting system/auxiliary window system according to this invention used as a solar convective heater.

FIG. 10 illustrates the energy-saving advantages of the double window system employing the heretofore described double glazing mounting system. By closing primary window 130 and opening slide members 30*a* and 30*b* slightly, windows 42*a* and 42*b* act through convection to heat air entering at bottom end 132, returning this warmed air to the room at top end 134. The darkened arrows indicate the convective principle. It should be noted that the auxiliary window system of FIG. 10, or similarly, the single system shown in FIG. 9, may be mounted either inside or outside the primary window 130. Further, although the systems are depicted as vertically slidable in FIGS. 1 and 10, horizontal sliding may be made possible by mounting system 101, shown in FIGS. 8 and 10, or system 10, depicted in FIGS. 1 and 4, along the top and bottom sides of the frame, i.e., along sides 136 and 138 of frame 140, FIG. 10.

Other embodiments will occur to those skilled in the art and are within the following claims:

What is claimed is:

1. A window mounting system comprising:

a track member having a base for attachment to a window frame, a side wall extending transversely to said base, and a cover extending from said side wall parallel to said base and having a curved shape facing said base, the distal end of said cover being spaced from the base to form an opening; and a slide member including a runner having a curved shape for nesting in said track member and slidingly engaging therewith, the width of said runner being greater than the width of said opening between said cover and base of said track member to allow for snap-insertion, a runner extension, and glazing support means fixed to said runner extension.

2. The window mounting system of claim 1 in which said base includes a recess for holding adhesive means for securing said track member to a window frame.

3. The window mounting system of claim 1 in which said cover has a generally concave shape facing said base and said runner has a generally concave shape for nesting therein.

4. The window mounting system of claim 1 in which said cover includes a planar portion parallel to said base and an angled portion at each end which extends outwardly from said planar portion and toward said base, one of said angled portions interconnecting with said side wall.

5. The window mounting system of claim 1 further including a sliding seal between said runner and said track member.

6. The window mounting system of claim 5 in which said seal is fixed to either said runner or said track member.

7. The window mounting system of claim 1 further including a sliding seal between said concave runner portion and said base.

8. The window mounting system of claim 7 in which said seal is fixed to either said runner or said base.

9. The window mounting system of claim 1 in which said runner includes a planar portion and an angled portion at each end which extends outwardly from said planar portion, one of said angled portions being interconnected with said extension.

10. The window mounting system of claim 1 in which said runner includes a chamber having an opening narrower than the interior thereof; said opening facing said base when said runner is inserted in said track.

11. The window mounting system of claim 10 further including a sliding seal between said concave runner portion and said base; said sliding seal having a thick portion received by said chamber with a width greater than said chamber opening and having a thin portion extending between said thick portion and said base member.

12. The window mounting system of claim 11 in which said seal is fixed to either said runner or said base.

13. The window mounting system of claim 1 in which said slide member further includes a bearing member carried by said runner extension for bearing on said window frame.

14. An auxiliary window system comprising:

a track member having a base for attachment to a window frame, a side wall extending transversely to said base, and a cover extending from said side wall parallel to said base and having a curved shape facing said base, the distal end of said cover being spaced from the base to form an opening;

a slide member including a runner having a curved shape for nesting in said track member and slidingly engaging therewith, the width of said runner being greater than the width of said opening between said cover and base of said track member to allow for snap-insertion, a runner extension and glazing support means fixed to said runner extension; and a glazing member secured by said glazing support means.

15. The auxiliary window system of claim 14 in which said base includes a recess for holding adhesive means for securing said track member to a window frame.

16. The auxiliary window system of claim 11 in which said cover has a generally concave shape facing said base and said runner has a generally concave shape for nesting therein.

17. The auxiliary window system of claim 14 in which said cover includes a planar portion parallel to said base and an angle portion at each end which extends outwardly from said planar portion and toward said base, one of said angled portions interconnecting with said side wall.

18. The auxiliary window system of claim 14 further including a sliding seal between said runner and said track member.

19. The auxiliary window system of claim 18 in which said seal is fixed to either said runner or said track member.

20. The auxiliary window system of claim 14 further including a sliding seal between said concave runner portion and said base.

21. The auxiliary window system of claim 20 in which said seal is fixed to either said runner or said base.

22. The auxiliary system of claim 14 in which said runner includes a planar portion and an angled portion at each end which extends outwardly from said planar portions, one of said angled portions being interconnected with said extension.

23. The auxiliary window system of claim 14 in which said runner includes a chamber having an opening narrower than the interior thereof; said opening facing said base when said runner is inserted in said track.

24. The auxiliary window system of claim 23 further including a sliding seal between said concave runner portion and said base; said sliding seal having a thick portion received by said chamber with a width greater than said chamber opening, and a thin portion extending between said thick portion and said base member.

25. The auxiliary window system of claim 24 in which said seal is fixed to either said runner or said base.

26. The auxiliary window system of claim 14 in which said slide member further includes a bearing member carried by said runner extension for bearing on said window frame.

27. A window mounting system comprising:

a first track member having a base for attachment to a window frame, a side wall extending transversely to said base, and a cover extending from said side wall parallel to said base and having a curved shape facing said base, the distal end of said cover being spaced from the base to form an opening;

a first slide member including a runner having a curved shape for nesting in said first track member and slidingly engaging therewith, the width of said runner being greater than the width of said opening between said cover and the base of said track member to allow for snap-insertion, a runner extension, and glazing support means fixed to said runner extension;

a second track member having a base connected with said first track member, a side wall extending transversely to said base, and a cover extending from said side wall parallel to said base and having a curved shape facing said base, the distal end of said cover being spaced from the base to form an opening; and a second slide member including a runner having a curved shape for nesting in said second track member and slidingly engaging therewith, the width of said runner being greater than the width of said opening between the cover and base of said second track member to allow for snap-insertion, a runner extension, and glazing support means fixed to said runner extension.

28. The window mounting system of claim 27 in which said base of said first track member includes a recess for holding adhesive means for securing said track member to a window frame.

29. The window mounting system of claim 27 in which in each track unit said cover has a generally concave shape facing said base and said associated runner has a generally concave shape for nesting therein.

30. The window mounting system of claim 27 in which in each track unit said cover includes a planar portion parallel to said base and an angled portion at each end which extends outwardly from said planar portion and toward said base, one of said angled portions interconnecting with said side wall.

31. The window mounting system of claim 27 further including a sliding seal between said runner of each slide member and the associated track member.

32. The window mounting system of claim 31 in which each seal is fixed to either said runner or the associated track member.

33. The window mounting system of claim 27 further including a sliding seal between the concave runner portion of each slide member and said base of the associated track member.

34. The window mounting system of claim 33 in which each seal is fixed to either said runner or the associated track member base.

35. The window mounting system of claim 27 in which said runner includes a planar portion and an angled portion at each end which extends outwardly from said planar portion, one of said angled portions being interconnected with said extension.

36. The window mounting system of claim 27 in which each slide member runner includes a chamber having an opening narrower than the interior thereof; said opening facing said base when said runner is inserted in the associated track.

37. The window mounting system of claim 36 further including a sliding seal between each runner and associated base; said sliding seal having a thick portion received by said chamber with a width greater than said chamber opening and having a thin portion extending between said thick portion and said base.

38. The window mounting system of claim 37 in which each seal is fixed to either said runner or the associated track member base.

39. The window mounting system of claim 27 in which said first slide member includes a bearing member carried by said first slide member runner extension for bearing on said window frame.

40. The window mounting system of claim 27 in which said second slide member includes a bearing member carried by the second slide member runner extension for bearing on said first track member.

41. An auxiliary window system comprising:

a first track member having a base for attachment to a window frame, a side wall extending transversely to said base, and a cover extending from said side wall parallel to said base and having a curved shape facing said base, the distal end of said cover being spaced from the base to form an opening;

a first slide member including a runner having a curved shape for nesting in said first track member and slidingly engaging therewith, the width of said runner being greater than the width of said opening between said cover and base of said first track member to allow for snap-insertion, a runner extension, and glazing support means fixed to said runner extension;

a first glazing member secured by said first slide member glazing support means;

a second track member having a base connected with said first track member, a side wall extending transversely to said base, and a cover extending from said side wall parallel to said base and having a curved shape facing said base, the distal end of said cover being spaced from the base to form an opening;

a second slide member including a runner having a curved shape for nesting in said second track member and slidingly engaging therewith, the width of said runner being greater than the width of the opening between said cover and base of said second track member to allow for snap-insertion, a runner extension, and glazing support means fixed to said runner extension; and a second glazing member secured by said second slide member glazing support means.

42. The auxiliary window system of claim 41 in which said base of said first track unit includes a recess for holding adhesive means for securing said track member to a window frame.

43. The auxiliary window system of claim 32 in which in each track unit said cover has a generally concave shape facing said base and said associated runner has a generally concave shape for nesting therein.

44. The auxiliary window system of claim 41 in which in each track unit said cover includes a planar portion parallel to said base and an angled portion at each end which extends outwardly from said planar portion and toward said base, one of said angled portions interconnecting with said side wall.

45. The auxiliary window system of claim 41 further including a sliding seal between said runner portion of each slide member and the associated track member.

46. The auxiliary window system of claim 45 in which each seal is fixed to either said runner or the associated track member.

47. The auxiliary window system of claim 41 further including a sliding seal between said concave runner portion of each slide member and said base of the associated track member.

48. The auxiliary window system of claim 47 in which each seal is fixed to either said runner or the associated track member base.

49. The auxiliary window system of claim 41 in which each said runner includes a planar portion and an angled portion at each end which extends outwardly from said planar portion, one of said angled portions being interconnected with said extension.

50. The auxiliary window system of claim 41 in which each slide member runner includes a chamber having an opening narrower than the interior thereof; said opening facing said base when said runner is inserted in the associated track.

51. The auxiliary window system of claim 50 further including a sliding seal between each runner and associated base; said sliding seal having a thick portion received by said chamber with the width greater than said chamber opening and having a thin portion extending between said thick portion and said base.

52. The auxiliary window system of claim 51 in which each seal is fixed to either said runner or the associated track member base.

53. The auxiliary window system of claim 41 in which said first slide member includes a bearing member carried by said first slide member runner extension for bearing on said window frame.

54. The auxiliary window system of claim 41 in which said second a slide member includes a bearing member carried by the second slide member runner extension for bearing on said first track member.

* * * * *